United States Patent [19]

Gilbert

[11] Patent Number: 4,604,532

[45] Date of Patent: Aug. 5, 1986

[54] TEMPERATURE COMPENSATED LOGARITHMIC CIRCUIT

[75] Inventor: Barrie Gilbert, Forest Grove, Oreg.

[73] Assignee: Analog Devices, Incorporated, Norwood, Mass.

[21] Appl. No.: 694,462

[22] Filed: Jan. 24, 1985

Related U.S. Application Data

[63] Continuation of Ser. No. 455,240, Jan. 3, 1983, abandoned.

[51] Int. Cl.[4] ..... G06G 7/12; G06G 7/24

[52] U.S. Cl. ..... 307/490; 307/491; 307/492; 328/145

[58] Field of Search ..... 328/141–145; 307/490–494, 310

[56] References Cited

U.S. PATENT DOCUMENTS

| | | | |
|---|---|---|---|
| 4,029,974 | 6/1977 | Brokaw | 307/310 |
| 4,454,433 | 6/1984 | Welland | 307/145 |
| 4,475,103 | 10/1984 | Brokaw et al. | 307/310 |

FOREIGN PATENT DOCUMENTS

| | | |
|---|---|---|
| 1472206 | 5/1977 | United Kingdom . |
| 1583993 | 4/1981 | United Kingdom . |

*Primary Examiner*—Stanley D. Miller
*Assistant Examiner*—B. P. Davis
*Attorney, Agent, or Firm*—Parmelee, Bollinger & Bramblett

[57] ABSTRACT

A log-amp or log-ratio circuit for producing a temperature-independent output signal corresponding to the logarithm of the ratio of a pair of input currents. The basic logarithm function is generated by a pair of opposed P-N junctions through which the respective input currents flow. Temperature compensation is effected by a circuit including a second pair of opposed P-N junctions which receive a PTAT current split between the junctions in accordance with a modulation factor proportional to the desired logarithmic function. The temperature-induced signal variations produced by the PTAT current source are equal and opposite to the temperature-induced signal variations produced in the first pair of P-N junctions, and a temperature-independent output signal is developed in accordance with the modulation factor applied to the PTAT current through the second pair of P-N junctions.

18 Claims, 4 Drawing Figures

$$\delta = \frac{I_B}{I_C}$$

TEMPERATURE COMPENSATED LOGARITHMIC CIRCUIT

This application is a continuation of application Ser. No. 455,240, filed Jan. 3, 1983, now abandoned.

BACKGROUND OF THE INVENTION

1. Field of the Invention

This invention relates to electrical circuits for producing output signals according to a logarithmic function. More particularly, this invention relates to improved circuitry for developing a temperature-independent logarithmic output signal.

2. Description of the Prior Art

Various kinds of analog logarithmic circuits have been used industrially for many years. These have included log-amps (having only one variable input signal) and log-ratio circuits (having two variable input signals). Generally, the logarithmic function is established by a pair of opposed P-N junctions carrying respective currents $I_1$, $I_2$, with the differential voltage kT/q (ln $I_1/I_2$) being used as the basic output signal. Since the output signal is proportional to absolute temperature, it is evident that some form of temperature compensation must be provided for any such circuitry which is required to function accurately at varying temperatures.

There has been a problem in providing temperature-compensated logarithmic circuits which are suitable for fabrication in monolithic form, i.e. integrated-circuit chips. Commonly, in prior circuits a resistor having a high temperature-coefficient (TC) is used to effect the required temperature compensation. However, providing such a resistor is difficult to do monolithically. As a consequence, an external high-TC resistor generally is employed. This is not satisfactory because the product must then be manufactured in module format rather than as a totally monolithic implementation.

SUMMARY OF THE INVENTION

In accordance with the invention, logarithmic circuits (either log-amp or log-ratio) are provided wherein the need for any special components, such as a temperature-compensation resistor, is eliminated by the use of compensation circuitry based on junction behavior alone.

In preferred embodiments of the invention, a pair of opposed P-N junctions are supplied with input currents $I_1$, $I_2$ to develop the basic logarithmic relationship. The resulting log-ratio signal is coupled to compensating circuitry including a second pair of P-N junctions with their common emitters supplied by a current source producing a current proportional-to-absolute-temperature (PTAT).

The PTAT current split between the second pair of junctions is modulated in accordance with the log ratio (ln $I_1/I_2$); the temperature-induced variations introduced by the first pair of junctions are compensated for by equal and opposite temperature-induced variations introduced by the PTAT current source. A final output signal is developed proportional to the modulation factor in the second pair of junctions, and this output signal is independent of temperature.

Other objects, aspects and advantages of the invention will be pointed out in, or apparent from, the following detailed description of preferred embodiments of the drawings.

DETAILED DESCRIPTION OF PREFERRED EMBODIMENTS

Figure 1:
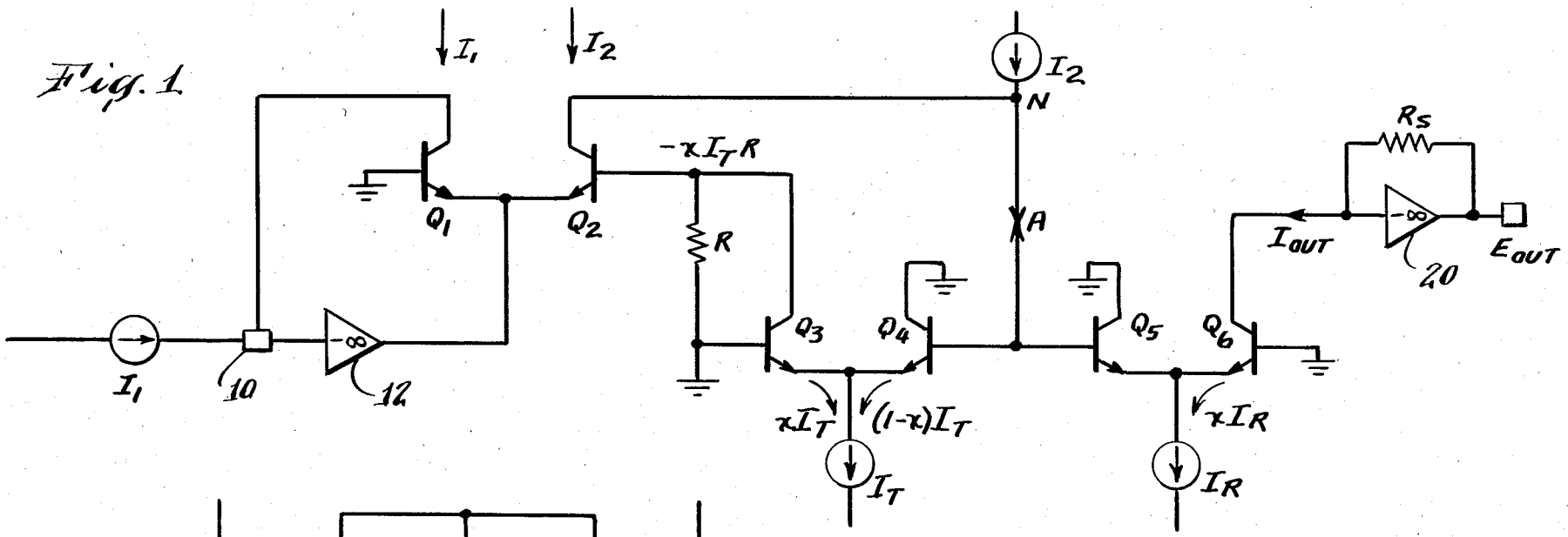
FIG. 1 is a schematic diagram of a relatively simple version of the basic circuit, illustrating the principles of the invention.

Referring now to FIG. 1, there is shown a relatively simple version of a logarithmic circuit comprising a pair of matched transistors $Q_1$, $Q_2$ having a common emitter connection to establish opposed P-N junctions. The base of $Q_1$ is grounded, and its collector is connected to an input terminal 10 to receive a variable input current $I_1$. This input terminal also is connected to the input of a high-gain inverting amplifier 12 the output of which drives the common emitter connection of $Q_1$, $Q_2$, forcing $I_1$ through $Q_1$.

The collector of $Q_2$ receives a current from a source $I_2$ which is a constant current in the case of a log-amp application, or a variable current for a log-ratio application. The amplifier 12 supplies the current $I_2$ on demand.

The base of $Q_2$ is connected through a resistor R to ground, and to the collector of a transistor $Q_3$. The base of $Q_3$ is grounded, and its emitter is connected to the emitter of a matched transistor $Q_4$ having its collector grounded. The common emitters of $Q_3$, $Q_4$ are connected to a current source $I_T$ which produces a PTAT current (i.e. proportional-to-absolute temperature). $Q_3$ carries a fraction of the PTAT current $xI_T$ while $Q_4$ carries the remaining current $(1-x)\ I_T$.

It will be seen that the collector current of $Q_3$ also passes through the resistor R. Thus, the voltage at the upper end of the resistor will be $-x\ I_T R$ with respect to ground. Accordingly, the loop equation from the grounded base of $Q_1$ to the grounded base of $Q_3$ can be written as:

$$\frac{kT}{q}\ln\frac{I_1}{I_s} = \frac{kT}{q}\ln\frac{I_2}{I_s} + x\,I_T R \tag{1}$$

where $I_s$ is the junction saturation current simplify the analysis merely for the purpose of illustration, it will be assumed that the product $I_T R$ is set at the value kT/q. Substituting this in equation (1) gives:

$$\frac{kT}{q}\ln\frac{I_1}{I_s} = \frac{kT}{q}\ln\frac{I_2}{I_s} + x\frac{kT}{q} \tag{2}$$

Combining terms and dividing by kT/q produces:

$$\ln\frac{I_1}{I_s} - \ln\frac{I_2}{I_s} = x \text{ or} \tag{3}$$

$$x = \ln\frac{I_1}{I_2} \tag{4}$$

Thus the modulation factor "x" is directly proportional to the desired logarithmic ratio, and is free from temperature effects. To obtain a corresponding output signal, it is only necessary to produce an output signal corresponding to "x".

This can be achieved, as illustrated in FIG. 1, by employing a third pair of matched P-N junctions $Q_5$, $Q_6$, coupled to the base of $Q_4$ and arranged in a mirrorimage configuration. A constant-current source $I_R$ is connected to the common emitters of $Q_5$, $Q_6$. It will be seen that the current through $Q_6$ is x $I_R$, and thus serves as the output current $I_{OUT}$. To develop a corresponding output voltage, the collector of $Q_6$ may be connected to an inverting high-gain amplifier 20 having a feedback resistor $R_s$. The ouput voltage then will be:

$$E_{OUT} = I_R R_s \ln \frac{I_1}{I_2} \quad (5)$$

Thus it will be understood that the output voltage is independent of temperature, and is produced without any need for special components such as high-TC resistors. Accordingly, such a circuit can readily be implemented entirely in monolithic format.

In a log-amp application, where $I_2$ is fixed, the error voltage at node N is not very important since it can be current-driven; the small base currents for $Q_4$, $Q_5$ may be negligibly small. $I_T$ is readily generated by an $E_{go}$ circuit, e.g. of the general type illustrated in FIG. 2 of U.S. Pat. No. 3,940,760 (Brokaw). It may also be noted that if $I_R$ and $I_T$ are nearly the same, the circuit does not even require good log-conformance from $Q_3$ to $Q_6$, since their ohmic errors are similar.

Figure 2:
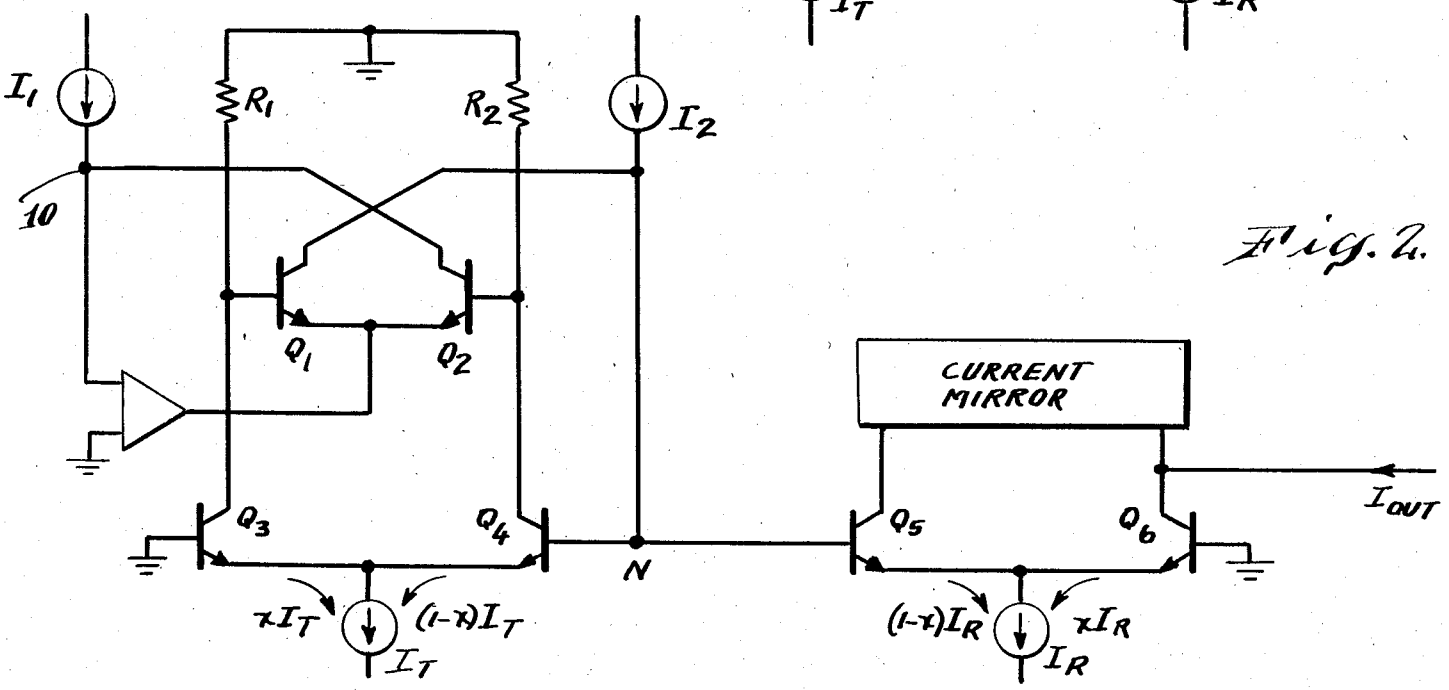
FIG. 2 is a modified embodiment using a balanced circuit configuration.

To provide a well-controlled virtual ground at node N, for example to implement a highly accurate log-ratio circuit, a low-gain, non-inverting amplifier could be inserted at the circuit point labelled A in FIG. 1. FIG. 2 shows another circuit arrangement in which node N is very close to ground for $I_1 = I_2$. Analysis of this balanced circuit is straight-forward, and shows that:

$$(2x - 1) = \ln \frac{I_1}{I_2} \quad (6)$$

Figure 3:
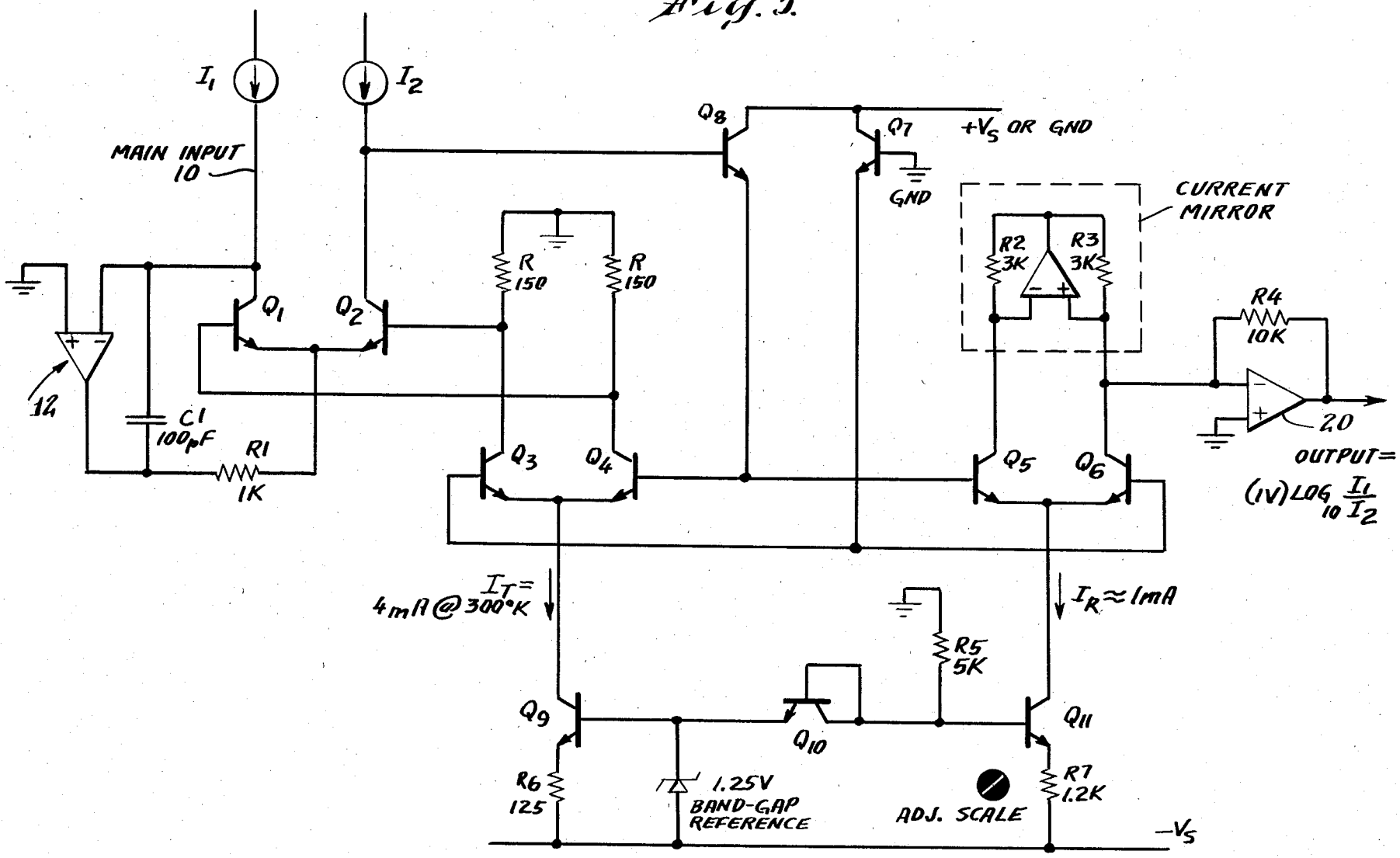
FIG. 3 is a more detailed exposition of a circuit of the type shown in FIG. 2.

Simply by way of example, FIG. 3 is provided to illustrate how some of the details of a practical circuit based on FIG. 2 might be implemented. The functioning of the circuit is straightforward in most respects. $Q_7$ and $Q_8$ serve a dual purpose by reducing the base currents from $Q_4$ through $Q_6$, and by providing some headroom for the collectors of the four transistors. $I_T$ and $I_R$ are set at relatively high values. This ensures that the resistor R can be sufficiently small so that base-current errors in $Q_1$ at the high-input end of the signal range cause negligible error in the output.

Figure 4:
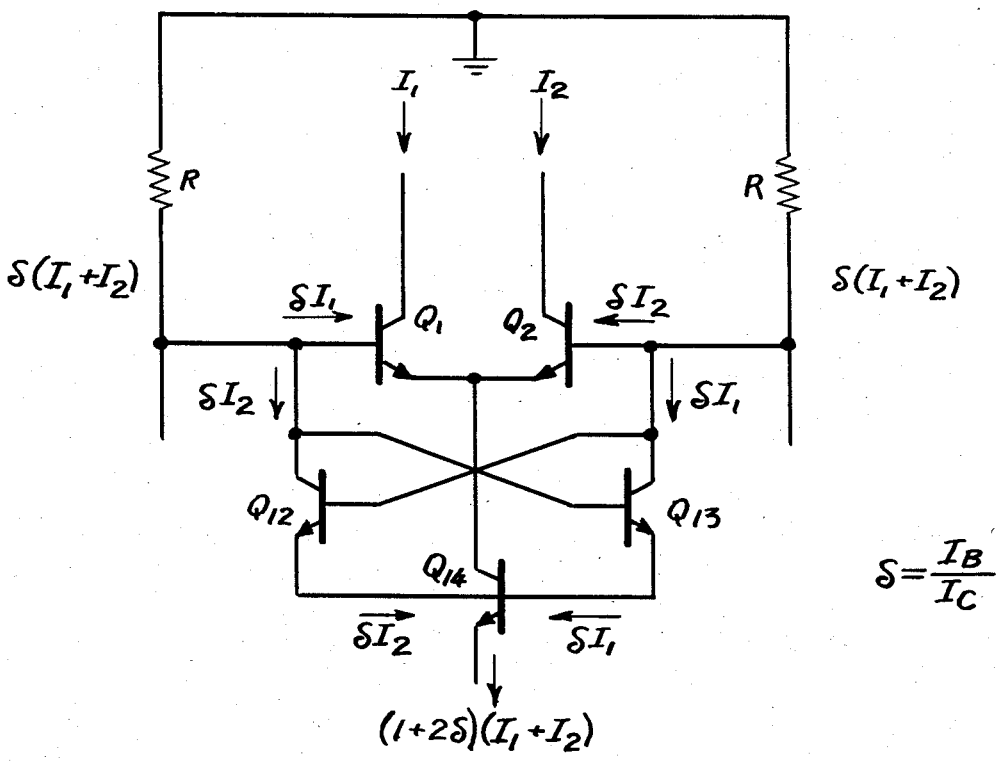
FIG. 4 is a supplemental modification of the core portion of FIG. 2.

Referring again to FIG. 2, it will be understood that finite beta in the "core" transistors $Q_1$ and $Q_2$ will have some adverse effect. More specifically, although base currents in $Q_1$ and $Q_2$ will not alter the voltage across the resistors R (since this is forced by the feedback system to always equal $V_T \ln (I_1/I_2)$, they do alter the value of the modulation index, x, required to set up this voltage, and hence introduce an error in the final output. FIG. 4 shows a supplemental modification to the core portion of the FIG. 2 arrangement which avoids this problem, in the following way. $Q_{14}$ generates a base current equal to the total base currents of $Q_1$ and $Q_2$. $Q_{12}$ and $Q_{13}$ form an emitter-coupled pair which proportion this current in the same way as $Q_1$ and $Q_2$ proportion the total emitter current $I_1 + I_2$. Due to the crossed connections, and assuming that the base-current defect factor $\delta(\approx 1/\beta)$ is small, the collector current of $Q_{12}$ is closely equal to the base current of $Q_2$; likewise, the collector current of $Q_{13}$ is closely equal to the base current of $Q_1$. Thus, the base current in each resistor is $\delta(I_1 + I_2)$, and the net differential error is zero.

Although several preferred embodiments of the invention have been disclosed herein in detail it is to be understood that this is for the purpose of illustrating the invention, and should not be construed as necessarily limiting the scope of the invention, since it is apparent that many changes can be made by those skilled in the art while still practicing the invention claimed herein.

What is claimed is:

1. A log circuit for producing an output signal proportional to the logarithm of an input signal and free from temperature induced variations, comprising:

input means responsive to said input signal and including means to develop a first signal proportional to the product of (1) the logarithm of said input signal and (2) absolute temperature;

circuit means including a PTAT (proportional-to-absolute-temperature) source producing a second signal and coupled to said input means;

said circuit means further including means for modulating the magnitude of said second signal in accordance with said logarithm while effecting cancellation of the temperature-related factors of said two signals; and output means for developing an output signal corresponding to said modulation of said second signal.

2. A circuit as claimed in claim 1, wherein said input means comprises differential means responsive to the input signal and to a reference signal to produce said first signal proportional to the logarithm of the ratio of said input and reference signals.

3. A circuit as claimed in claim 2, wherein said differential means comprises first and second transistors having common emitters;

said input and reference signals comprising currents passing through said transistors respectively.

4. A circuit as claimed in claim 3, wherein said circuit means comprises resistor means coupled to the base of said second transistor; and means coupling said PTAT source to said resistor means to provide for a flow of PTAT current therethrough.

5. A circuit as claimed in claim 4, wherein said coupling means comprises third and fourth transistors having their emitters connected together;

said resistor means being connected between the collector and base of said third transistor;

said PTAT source being connected to the emitters of said third and fourth transistors.

6. A circuit as claimed in claim 5, wherein the base of said first transistor is connected to a reference potential;

the base of said second transistor being connected to the collector of said third transistor; and the base of said third transistor being connected to a reference potential.

7. A circuit as claimed in claim 3, wherein the base of said first transistor is connected to a reference potential;

said circuit means comprising a resistor connected between the base of said second transistor and a reference potential;

said PTAT source being coupled to said resistor to cause a flow of PTAT current therethrough so as to develop said second signal.

8. A circuit as claimed in claim 7, including a high-gain amplifier having its output connected to the common emitters of said first and second transistors and its input connected to the collector of said first transistor;

the input of said amplifier also being connected to the input terminal receiving and forcing the input current through the first transistor.

9. A circuit as claimed in claim 8, wherein said reference signal comprises a current source connected to the collector of said second transistor.

10. A circuit as claimed in claim 7, wherein said circuit means further comprises third and fourth transistors with a common emitter connection;

said third transistor being coupled to said resistor to carry the current thereof;

said circuit means providing for a split of current from said PTAT source between said third and fourth transistors with the proportion of current through said third transistor serving as the modulation factor responsive to the ratio of currents.

11. A circuit as claimed in claim 10, including fifth and sixth transistors with their emitters connected together;

said fifth and sixth transistors being coupled to said third and fourth transistors;

said output means including means for replicating in said sixth transistor a current modulation corresponding to that in said third transistor;

said output means further comprising means responsive to the current flow through said sixth transistor for developing an output signal.

12. A balanced log ratio circuit comprising:

A first pair of matched transistors with common emitters;

the collectors of said transistors being connected to respective input terminals to receive input currents;

an amplifier having its input coupled to one of said input terminals and its output connected to said common emitters;

a pair of resistors each connected at one end to a respective base of said pair of transistors;

the other ends of said resistors being connected together to a reference potential;

a second pair of matched transistors having their collectors connected respectively to the bases of said first pair of transistors and their emitters connected together;

a source of PTAT (proportional-to-absolute-temperature) current connected to said second pair of emitters to produce therethrough and through said respective resistors a flow of current modulated in accordance with the logarithm of the ratio of said input currents; and output means to develop an output signal in accordance with said modulation of said PTAT current.

13. A circuit as claimed in claim 12, wherein said output means comprises a third pair of transistors matched to said second pair;

the emitters of said third pair being connected together to a source of constant current;

said third pair of transistors being coupled to said second pair to provide that the current passing through said third pair is modulated in correspondence to the modulation of current in said second pair;

said output means comprising means responsive to the current flowing through one of said third pair of transistors.

14. A circuit as claimed in claim 13, including a current mirror connected to the collectors of said third pair of transistors;

said output means being connected to the collector of one of said third pair of transistors.

15. The method of developing a temperature-independent signal corresponding to the logarithm of an input signal, comprising:

developing a first signal representing the product of (1) the logarithm of said input signal and (2) absolute temperature;

developing a second signal from a PTAT (proportional-to-absolute-temperature) current source;

combining said first and second signals;

setting the magnitude of said second signal to provide for cancellation of the temperature-dependent factors of said two signals;

modulating the magnitude of said second signal in accordance with the logarithm of the ratio between said input signal and a reference signal; and developing an output signal in accordance with the modulation of said second signal.

16. A circuit as claimed in claim 15, wherein said first signal is developed by a pair of opposed P-N junctions with one carrying a first current corresponding to said input signal and the other carrying a second current.

17. A circuit as claimed in claim 16, wherein the modulation of said second signal is effected by a second pair of opposed P-N junctions.

18. A circuit as set forth in claim 12, including means for avoiding the effects of finite beta in the first pair of transistors and comprising:

a third pair of emitter-coupled transistors having their collectors connected respectively to the bases of said first pair of transistors respectively;

the collector of each of said third pair of transistors being connected to the base of the other of said third pair of transistors; and an additional transistor having its collector connected to the emitters of said first pair of transistors and its base connected to the emitter of said third pair of transistors.

* * * * *